United States Patent [19]

Olowinski et al.

[11] 4,299,085

[45] Nov. 10, 1981

[54] TEXTILE SPINDLE MOUNTING

[75] Inventors: Edward J. Olowinski; Richard A. John, both of Erie, Pa.

[73] Assignee: Lord Corporation, Erie, Pa.

[21] Appl. No.: 195,290

[22] Filed: Oct. 8, 1980

[51] Int. Cl.[3] ..... D01H 7/12

[52] U.S. Cl. ..... 57/130; 57/135; 248/638

[58] Field of Search ..... 57/129, 130, 132, 135; 248/560, 616, 610–613, 638

[56] References Cited

U.S. PATENT DOCUMENTS

| | | | |
|---|---|---|---|
| 2,650,465 | 9/1953 | Westall | 57/135 |
| 2,872,774 | 2/1959 | Fink | 57/129 |
| 2,894,365 | 7/1959 | Meyer-Busche | 57/132 |
| 3,885,767 | 5/1975 | Olowinski et al. | 248/204 |
| 3,942,314 | 3/1976 | Olowinski | 57/135 |
| 4,045,948 | 9/1977 | Hannibal | 57/129 |
| 4,067,184 | 1/1978 | Johnson | 57/135 |
| 4,187,668 | 2/1980 | Olowinski et al. | 57/130 |

*Primary Examiner*—Donald Watkins
*Attorney, Agent, or Firm*—Thomas L. Kautz

[57] ABSTRACT

A textile spindle mount is provided by the subject invention in which a layer of elastomeric material is disposed between and attaches to a flat washer along its bottom surface and a cupped washer along its top surface. The cupped washer includes end sections which extend downwardly and attach to the outer edge of the elastomer layer for limiting the bulging thereof under compression loads. The bulging of the elastomer layer is further controlled by removing a generally curved section of elastomeric material adjacent the outer edge of the elastomer layer. As a result, a high compression to shear springrate ratio is obtained with the spindle mount herein which is capable of good noise and vibration isolation and can accommodate high compression loads without bond failure.

6 Claims, 5 Drawing Figures

TEXTILE SPINDLE MOUNTING

FIELD OF THE INVENTION

The subject invention relates generally to the field of textile spindle mountings, and more particularly, to a simple and relatively inexpensive spindle mount capable of good noise attenuation and vibration isolation.

BACKGROUND OF THE INVENTION

The control of noise emanated from revolving textile spindles has been a continuing problem for the textile industry for many years. A typical textile machine includes 140 to as many as 504 spindles which rotate at operating speeds ranging from 8,000 rpm to 14,000 rpm. At such high speeds, even minimal unbalance in the spindle and bobbins create vibration and generate noise. The bearings within the bolsters of the spindle assembly are an additional source of noise. Moreover, since the spindle-bolster assembly is mounted directly to the machine rail, the combined noise level produced by the spindle and bobbin vibrations and the bearings is transmitted directly to the machine rail which further magnifies the noise intensity. Unless the mounting assembly which secures the spindle and bolster to the machine rail includes some form of vibration and noise attenuating means, the noise levels developed within a textile plant can be literally deafening.

Although a concerted effort has been made by the textile industry to design mounting systems capable of reducing noise to acceptable levels within their plants, most of the prior art arrangements are unduely complex and from a practical and economic standpoint are of little value. In addition, such prior art designs generally may not be retrofitted to existing spindles without costly and time consuming alterations.

SUMMARY OF THE INVENTION

A relatively inexpensive but effective noise and vibration attenuating textile spindle mount is provided by the present invention, which may be retrofitted to existing machinery. The spindle mount includes a layer of elastomeric material disposed between and attaching to a rigid flat washer along its bottom surface and a rigid cupped washer along its top surface. The cupped washer, having a larger diameter than the bottom washer, is formed with curved edges which extend downwardly along the outer edge of the elastomer layer to restrict its bulge area for purposes to become apparent below. The elastomer layer of the spindle mount herein is contoured at the point of attachment to the curved edges of the cupped washer to further control its bulge characteristics under the application of compressive load as the spindle assembly is mounted to the rail of the textile machine. In addition to restricting the bulge of the elastomer layer, the cupped washer acts as a safety means to avoid damage to the spindle mount in the event of improper installation. The curved edges of the cupped washer, extending outwardly beyond the bottom rigid washer, will engage or "bottom" on the machine rail in the event the spindle mount is installed too tightly. This protects the elastomer layer from being squeezed too tightly between the washers, thus preventing a possible failure in shear.

The configuration of the subject invention enables the compression to shear spring rate ratio to be accurately controlled for optimum vibration isolation. By restricting the bulge area of the elastomer layer, a relatively high compression spring rate may be obtained to accommodate the compression loads applied to the spindle mount during installation, while maintaining a relatively soft shear sring rate which acts to isolate the vibrations of the spindle assembly from the machine rail.

Therefore it is an object of the subject invention to provide a spindle mount having a high compression to shear spring rate ratio for isolating the vibrations of the spindle assembly from the machine rail.

It is a further object of the subject invention to provide a spindle mount including a layer of elastomeric material disposed between and attaching to a rigid bottom washer and a cupped top washer.

It is another object of the subject invention to provide a spindle mount in which a layer of elastomeric material having a cut-out section adjacent its outer edge is disposed between and attaches to a rigid bottom washer and a cupped top washer formed with the edges which extend downwardly and attach to the outer edge of the elastomer layer.

It is a still further object of the subject invention to provide a spindle mount in which a high compression to shear spring rate ratio is obtained by controlling the bulge area of an elastomeric layer disposed between a pair of rigid washers.

DESCRIPTION OF THE DRAWINGS

Objects in addition to the foregoing will become apparent upon consideration of the following description taken in conjunction with the accompanying drawings wherein.

DETAILED DESCRIPTION OF THE INVENTION

Figure 1:
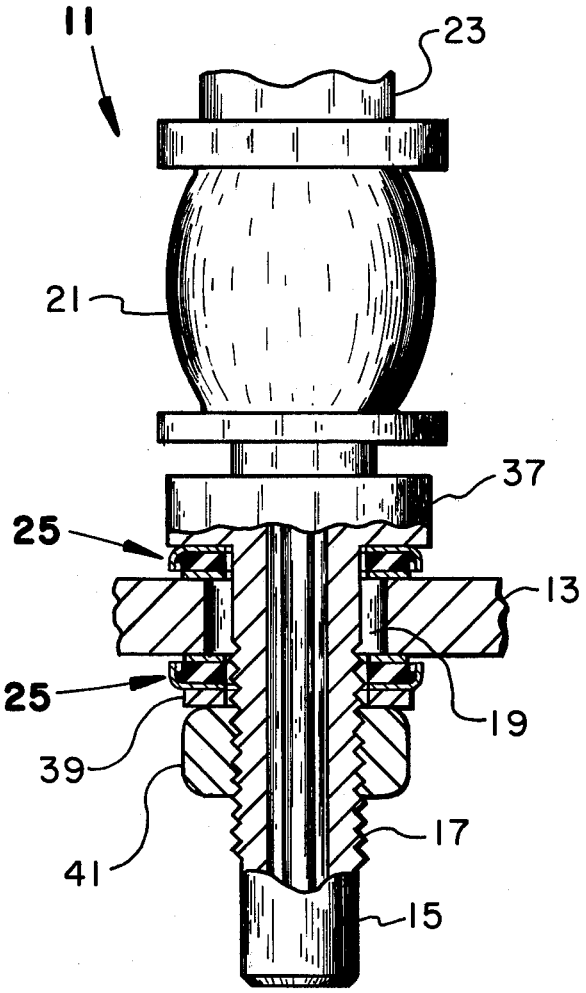
Figure 1 PRIOR ART
FIG. 1 is a partial front view of a spindle assembly including the spindle mount of the subject invention.

Referring now to the drawings, a textile spindle assembly labelled generally with the reference 11 is shown secured to the rail 13 of a textile machine. Spindle assembly 11 is conventional in design and includes a bolster 15 having a threaded section 17 at its lower end, which extends upwardly through an opening 19 of larger diameter formed in machine rail 13. The remaining elements of spindle assembly 11 including whorl 21, spindle 23 and the bobbin-ring assembly (not shown) which carries the yarn are well-known.

As mentioned above, the spindles 23 of a textile machine rotate at operating speeds ranging from 8,000 rpm to 14,000 rpm and there may be up to 500 or more spindles 23 on each machine. It can be appreciated from viewing FIG. 1, that the noise and vibration produced by the rotation of spindle 23 would be transmitted through whorl 21 and bolster 15 directly to machine rail 13 in the absence of some means of noise and vibration isolation therebetween. Although several attempts to solve this problem have been made, prior art solutions are generally complicated, expensive and may not be economically retrofitted to existing machines.

Figure 2:
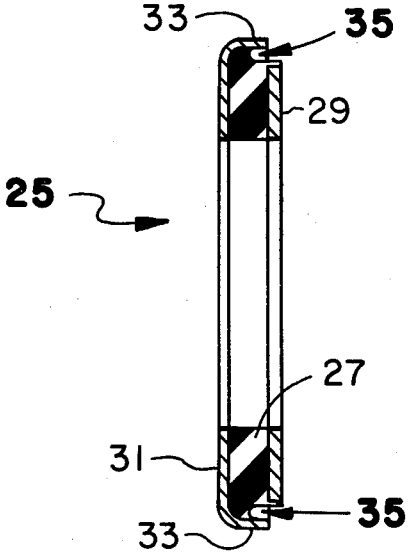
FIG. 2 is a cross-sectional view of the spindle mount herein taken generally along line 2—2 of FIG. 3.
Figure 3:
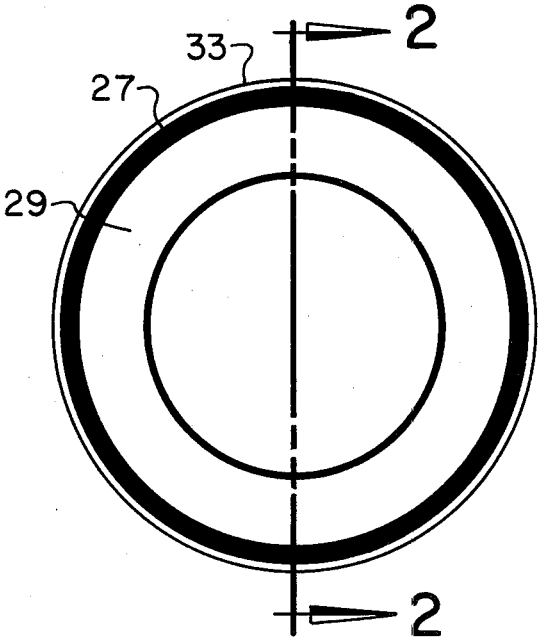
FIG. 3 is a bottom view of the spindle mount of FIG. 2.

The subject invention provides a spindle mount labelled generally with the reference 25, which is capable of good noise and vibration isolation and may be economically produced and retrofitted to many existing textile machines. Spindle mount 25 includes an annular layer of elastomeric material 27 disposed between and attaching to a flat washer 29 and a cupped washer 31, each formed of steel or a suitable equivalent. The elastomer layer 27 may be attached to washers 29 and 31 by adhesive coatings, vulcanization or any other suitable means. As shown in FIG. 2, the cupped washer 31 is of larger diameter than flat washer 29 and includes a curved edge section 33 which extends from the upper surface of the elastomer layer 27 downwardly along the outer edges thereof. Although edge section 33 is shown with a generally curved shape, it is contemplated that various other end configurations of washer 31 may be utilized to extend along the outer edge of elastomer layer 27. The elastomer layer 27 extends outwardly from flat washer 29 on the bottom surface thereof, and includes a contoured section 35 beginning at the base of edge section 33 of cupped washer 31 and ending at the outer edge of flat washer 29. The contoured section 35 of elastomer layer 27 is essentially a curved open space where the elastomeric material has been removed to control bulging under compressive load as discussed below.

Referring now to FIG. 1, a pair of spindle mounts 25 according to the subject invention are shown in their installed position. One spindle mount 25 is disposed between a bolster flange 37 and the top surface of machine rail 13, and the other spindle mount 25 is disposed between a bolster washer 39 and the bottom surface of machine rail 13. The spindle assembly 11 is first vertically aligned within the opening 19 of machine rail 13, and then a bolster nut 41 is tightened along the threaded section 17 of bolster 15 against bolster washer 39 to lock spindle assembly 11 in place. The spindle mounts 25 are thus compressed between machine rail 13, and bolster flange 37 and bolster washer 39. In addition, an adhesive coating may be applied during the installation procedure to the surface of flat washers 29 which face rail 13, to provide added resistence to lateral movement of the spindle assembly 11 within opening 19.

Figure 4:
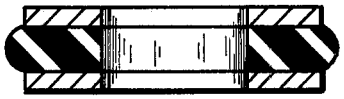
FIG. 4 is a front view of a prior art spindle mount subjected to compression loads.

It can be appreciated that to maintain a textile spindle assembly in alignment at operating speeds ranging from 8,000 to 14,000 rpm, high compressive loads must be applied to the spindle mounts. At the same time, a sufficiently soft shear springrate is needed in the spindle mounts to provide adequate noise and vibration isolation between the spindle assembly and rail of the textile machine. Referring to FIG. 4, one prior art spindle mount is shown in which a layer of elastomer is disposed between a pair of rigid, flat washers. While adequate noise and vibration isolation may be provided with this design, it has been found that the high compressive loads applied to such spindle mounts, which are necessary for proper stability of the spindle assembly, create excessive bulging of the elastomer layer between the upper and lower flat washers. As the elastomer layer bulges outwardly to the extent permitted by such spindle mounts (See FIG. 4), excessive stresses are imposed on the bond between the elastomer layer and washers. In the event of a bond failure, non-uniform stress distribution is created in the spindle mount which can result in misalignment of the spindle assembly. While the compression springrate may be increased to accommodate such loads by substituting a stiffer elastomeric material, the shear springrate would also be increased thus sacrificing the desired level of noise and vibration isolation capability.

In addition, excessive tightening of the bolster nut during installation of the spindle assembly can result in failure in shear of the elastomer layer in the spindle mount of FIG. 4. Although the elastomer layer shown in FIG. 4 appears to be relatively thick, it is exaggerated for purposes of illustration and in an actual application will measure only 0.10–0.15 of an inch. A mechanic could thus inadvertently tighten the bolster nut beyond prescribed limits and unknowingly damage or destroy the spindle mount. Such errors are unfortunately difficult to detect prior to start up of the textile machine, at which time a delay in operation to replace damaged spindle mounts could prove to be costly.

Figure 5:
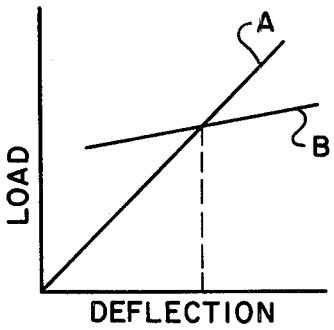
FIG. 5 shows the appropriate load deflection curves in shear and compression for the spindle mount herein.

The spindle mounts 25 herein are designed to overcome each of problems mentioned above in a compact, inexpensive configuration. It has been found that by controlling the bulge area of the elastomer layer 27 in spindle mounts 25, an appropriate ratio between the compression and shear spring rates may be obtained with minimal risk of bond failure. This is shown graphically in FIG. 5 where the load deflection curves for spindle mount 25 in compression (Curve A) and shear (Curve B) are depicted. As shown in FIG. 2, the curved edge section 33 of cupped washer 31 engages the entire outer edge of elastomer layer 27. The bulging of elastomer layer 27 under compressive load is thus confined to the area of the contoured section 35 of elastomer layer 27 in which a generally curved portion of elastomeric material between the curved edge section 33 of cupped washer 31 and the outer edge of flat washer 29 is removed. As the bolster nut 41 is tightened, the compressive load applied to spindle mounts 25 causes the elastomeric material adjacent the contoured section 35 to bulge outwardly. That portion of the elastomer layer 27 which is attached to the curved edge section 33 of cupped washer 31 is restricted from bulging.

By controlling the area of elastomer layer 27 which may bulge under load, the incidence of bond failure between the washers 29 and 31 and elastomer layer 27 is greatly reduced. Moreover, the compression spring rate of the elastomer layer 27 is effectively increased, thus eliminating the need for substitution of a stiffer elastomeric material with a correspondingly higher shear spring rate as in the prior art. It is contemplated that a compression to shear spring rate ratio in the range of 8 to 16 may be obtained with the configuration of spindle mounts 25, which has proven to be effective in accommodating the compressive forces and in isolating noise and vibrations encountered in typical installations.

In addition to restricting the bulge area of elastomer layer 27, the curved edge section 33 of cupped washer 31 provides an effective safety feature to protect spindle mounts 25 from damage due to improper installation. Using proper installation procedures, the bolster nut 41 is tightened so that the bottom surface of the edge section 33 of cupped washer 31 is a predetermined distance from the machine rail 13. A feeler gauge or any other suitable means may be used to check the clearance between the machine rail 13 and edge section 33, to assure that the elastomer layer 27 has been pre-compressed an appropriate amount and that the spindle assembly 11 is securely mounted to machine rails 13. In the event a mechanic inadvertently tightens the bolster nut 41 beyond the designed limit, the edge section 33 of cupped washer 31 contacts or "bottoms" against machine rail 13 prior to the point at which elastomer layer 27 will fail in shear. This feature of the subject invention not only avoids time consuming and costly replacement of improperly installed spindle mounts, but provides an efficient and easy means of installing the spindle mounts herein without guesswork as to the proper amount of torque to apply to bolster nut 41.

While the invention has been described with reference to a preferred embodiment, it will be understood by those skilled in the art that various changes may be made and equivalents may be substituted for elements thereof without departing from the scope of the invention. In addition, many modifications may be made and equivalents substituted to adapt a particular situation or material to the teachings of the invention without departing from the essential scope thereof. Therefore it is intended that the invention not be limited to the particular embodiment disclosed as the best mode for carrying out this invention, but that the invention will include all embodiments falling within the scope of the appended claims.

What is claimed is:

1. In a textile spindle assembly of a textile machine, said textile spindle assembly including a bolster threaded at one end and extending upwardly through an opening in the rail of said textile machine, a bolster nut being moveable along said threaded portion of said bolster below said rail and a bolster washer being attached to said bolster above said rail, and a whorl, spindle, ring and bobbin extending upwardly from said bolster and concentric therewith to form the upper portion of said spindle assembly, the improvement comprising a pair of spindle mounts for securing said spindle assembly to said rail and isolating noise and vibration therebetween, each of said spindle mounts including a rigid bottom washer, a top washer of greater diameter than said bottom washer, said top washer being formed with a downwardly extending end portion, an annular layer of elastomeric material concentrically disposed between and attaching to said top and bottom washers, the outer edge of said elastomer layer extending outwardly from said bottom washer and attaching to said end portion of said top washer, said elastomer layer being formed with a contoured section adjacent said outer edge thereof, one of said spindle mounts being disposed concentric with said bolster between said bolster nut and said rail and the other of said spindle mounts being disposed concentric with said bolster between said bolster washer and said rail, whereby upon application of compression loads to said spindle mounts by tightening of said bolster nut to secure said spindle assembly to said rail said elastomer layer is selectively restricted from bulging outwardly to accommodate said compression loads while providing isolation of noise and vibrations between said spindle assembly and said rail.

2. The spindle mounts of claim 1 wherein said end portions of said top washer are curved to provide said top washer with a cup-like shape for restricting the bulge of said elastomer layer.

3. The spindle mounts of claim 1 wherein said contoured section of said elastomer layer is a generally curved open area wherein elastomeric material is removed, said open area extending from said end portion of said top washer to the outer edge of said bottom washer.

4. The spindle mounts of claim 1 wherein said end portion of said top washer is a safety means, said end portion contacting said rail upon excess tightening of said bolster nut to prevent damage to said elastomer layer.

5. In a textile spindle assembly of a textile machine, said textile spindle assembly including a bolster threaded at one end and extending upwardly through an opening in the rail of said textile machine, a bolster nut being moveable along said threaded portion of said bolster below said rail and a bolster washer being attached to said bolster above said rail, and a whorl, spindle, ring and bobbin extending upwardly from said bolster and concentric therewith to form the upper portion of said spindle assembly, the improvement comprising a pair of spindle mounts for securing said spindle assembly to said rail and isolating noise and vibrations therebetween, each of said spindle mounts including a rigid bottom washer, a top washer of greater diameter than said bottom washer, said top washer being formed with a downwardly extending end portion, an annular layer of elastomeric material concentrically disposed between and attaching to said top and bottom washers, the outer edge of said elastomer layer extending outwardly from said bottom washer and attaching to said end portion of said top washer, said elastomer layer being formed with generally curved open area wherein elastomeric material is removed, said open area extending from said end portion of said top washer to the outer edge of said bottom washer, one of said spindle mounts being disposed concentric with said bolster between said bolster nut and said rail and the other of said spindle mounts being disposed concentric with said bolster between said bolster washer and said rail, whereby upon application of compression loads to said spindle mounts by tightening of said bolster nut to secure said spindle assembly to said rail the portion of said elastomer layer adjacent said open area bulges outwardly to accommodate said compression loads, said elastomer layer providing isolation of noise and vibrations between said spindle assembly and said rail.

6. In a textile spindle assembly of a textile machine, said textile spindle assembly including a bolster threaded at one end and extending upwardly through an opening in the rail of said textile mchine, a bolster nut being moveable along said threaded portion of said bolster below said rail and bolster washer being attached to said bolster above said rail, and a whorl, spindle, ring and bobbin extending upwardly from said bolster and concentric therewith to form the upper portion of said spindle assembly, the improvement comprising a pair of spindle mounts for securing said spindle assembly to said rail and isolating noise and vibrations therebetween, each of said spindle mounts including a rigid bottom washer, a top washer of greater diameter than said bottom washer, said top washer being formed with a downwardly extending end portion, an annular layer of elastomeric material concentrically disposed between and attaching to said top and bottom washers, the outer edge of said elastomer layer extending outwardly from said bottom washer and attaching to said end portion of said top washer, said elastomer layer being formed with a contoured section adjacent said outer edge thereof, one of said spindle mounts being disposed concentric with said bolster between said bolster nut and said rail and the other of said spindle mounts being disposed concentric with said bolster between said bolster washer and said rail, whereby upon application of compression loads to said spindle mounts by tightening of said bolster nut to secure said spindle assembly to said rail said elastomer layer is selectively restricted from bulging outwardly to accommodate said compression loads while providing isolation of noise and vibrations between said spindle assembly and said rail, said end portion of said top washer engaging said rail upon further application of said compression loads to prevent damage to said elastomer layer.

* * * * *